United States Patent [19]

Ingemansson

[11] Patent Number: 4,767,061

[45] Date of Patent: Aug. 30, 1988

[54] BLOWING NOZZLE FOR A HIGHLY PRESSURIZED GASEOUS FLUID

[75] Inventor: Stig Ingemansson, Mölndal, Sweden

[73] Assignee: Ingemanssons Ingenjorsbyra AB, Gothenburg, Sweden

[21] Appl. No.: 16,383

[22] PCT Filed: Jun. 5, 1986

[86] PCT No.: PCT/SE86/00263

§ 371 Date: Jan. 28, 1987

§ 102(e) Date: Jan. 28, 1987

[87] PCT Pub. No.: WO86/07289

PCT Pub. Date: Dec. 18, 1986

[30] Foreign Application Priority Data

Jun. 7, 1985 [SE] Sweden ..... 8502825

[51] Int. Cl.[4] ..... B05B 1/14

[52] U.S. Cl. ..... 239/566; 239/567; 239/568

[58] Field of Search ..... 239/552, 558, 567, 568, 239/553, 556, 566

[56] References Cited

U.S. PATENT DOCUMENTS

| | | | |
|---|---|---|---|
| 1,245,346 | 11/1917 | Humphrey | 239/568 |
| 2,391,934 | 1/1946 | White | 239/552 |
| 2,407,349 | 9/1946 | Shaw | 239/567 |
| 2,570,972 | 10/1951 | Nakken | 239/568 |
| 3,606,169 | 9/1971 | West | 239/597 |
| 3,865,311 | 2/1975 | Paxhia et al. | 239/568 |
| 4,204,631 | 5/1980 | Hruby, Jr. | 239/552 |

FOREIGN PATENT DOCUMENTS

| | | |
|---|---|---|
| 0030927 | 6/1981 | European Pat. Off. . |
| 2755993 | 6/1978 | Fed. Rep. of Germany . |
| 8106651 | 7/1985 | Sweden . |

*Primary Examiner*—Andres Kashnikow
*Assistant Examiner*—Karen B. Merritt
*Attorney, Agent, or Firm*—Holman & Stern

[57] ABSTRACT

A blowing nozzle for a highly pressurized gaseous fluid comprising at least two narrow slot-form exhaust passages (12) having a width (d) insignificantly larger than the size of polluting particles occurring in said fluid and a length (L) no more than ten times the average width (d) of each slot, the exhaust passages extending in parallel or radially over the end surface of the nozzle in a projection perpendicular to its longitudinal axis.

15 Claims, 3 Drawing Sheets

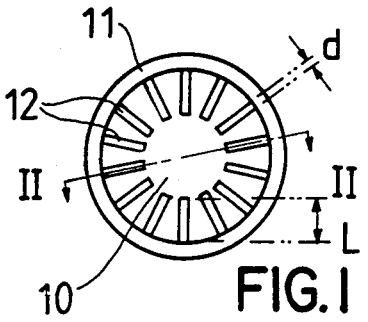
FIG. 1
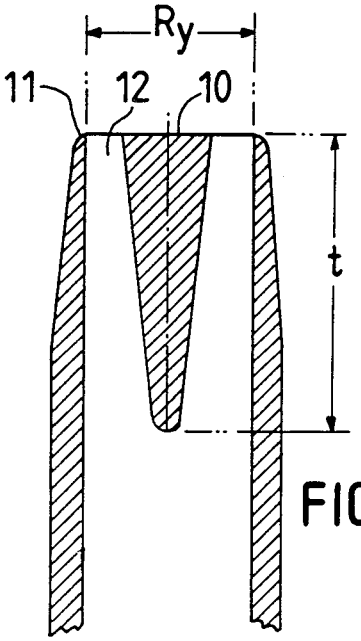
FIG. 2b
FIG. 4
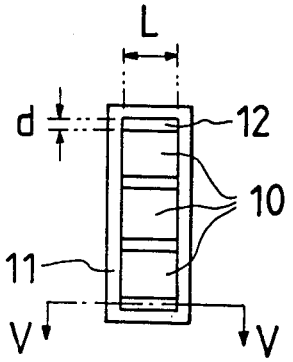
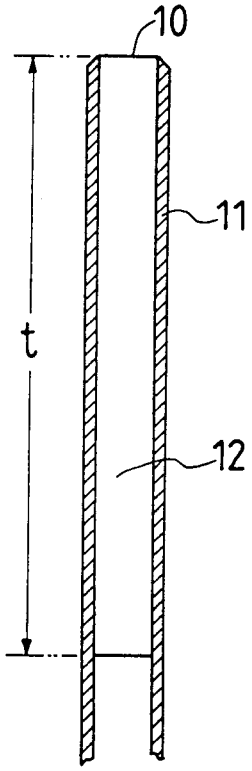
FIG. 5
FIG. 3
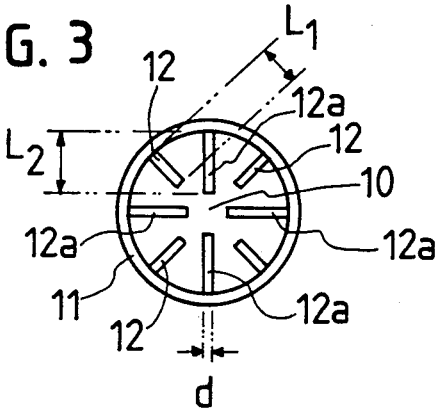

FIG. 6
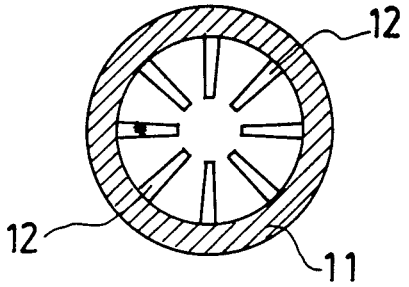
FIG. 7
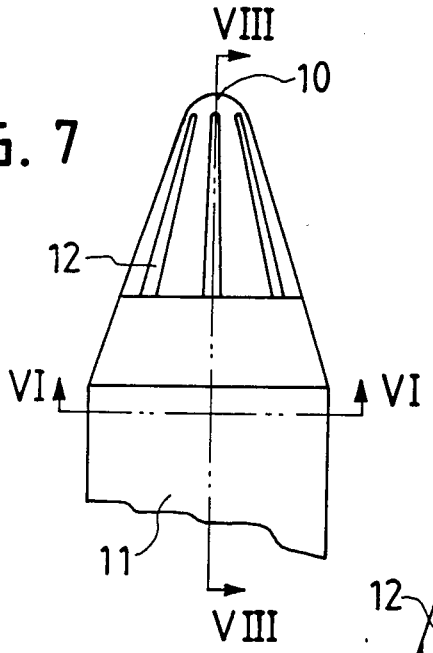
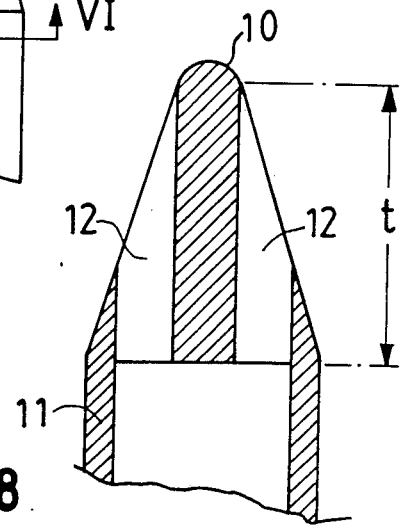
FIG. 8

BLOWING NOZZLE FOR A HIGHLY PRESSURIZED GASEOUS FLUID

CROSS REFERENCE TO RELATED APPLICATION(S)

This United States application stems from PCT International Application No. PCT/SE86/00263 filed June 5, 1986.

BACKGROUND OF THE INVENTION

Field of the Invention

The present invention concerns a blowing nozzle for a highly pressurized gaseous fluid comprising at least two narrow exhaust passages having a width insignificantly larger than the size of particles, occurring in said fluid.

Description of the Prior Art

Blowing nozzles are used for various industrial purposes, e.g. to blow away cuttings from a boring and other debris from a workpiece, to cool during welding or other kind of heat generating work, as exhausts from pneumatic machines, or for drying of paint.

A major problem with these devices is the risk of the noise level becoming hazardous, when a high blowing power is needed. Noise levels around 113 dB (A) are not uncommon for blowing nozzles with high output.

Noise reducing blowing nozzles are known, e.g. from Swedish patent application No. SE 7806883-0, which has several small circular passages. These small passages must be drilled with a very high degree of precision, in order to achieve the desired noise reducing effect. Because of the necessity for a high degree of precision these nozzles are comparatively expensive to manufacture. At the same time the blowing force possible with one of these nozzles is limited, which means that several nozzles must be mounted in parallel in order to reach a desired large blowing force. This means that these noise-reducing blowing nozzles in many cases are a very expensive solution to the noise problem.

BRIEF SUMMARY OF THE INVENTION

The object of the present invention is therefore to produce a cheap and efficient nozzle with noise reducing properties, and by which it is possible to reach a considerably larger blowing force for a given frontal area, compared with corresponding known blowing nozzles.

The invention is characterized in that the exhaust passages are slot-formed, each having a length, no more than ten times the average width of each slot, and that they extend in parallel or radially over the end surface of the nozzle, in a projection perpendicular to its longitudinal axis.

According to one advantageous embodiment of the invention, the depth or axial length of each slot-formed exhaust passage is at last five to ten times the length of said slot.

Preferably several exhaust passages are formed in parallel with the longitudinal axis of the nozzle in a central body, which is surrounded by a casing.

According to another advantageous embodiment of the invention the nozzle has a circular front with exhaust passages radially arranged concentrically around a common longitudinal axis, wherein the slot-formed exhaust passages are arranged with a minimum individual distance (distance between centers) of three times the slot width.

Preferably, the passages, as seen along their longitudinal axis, diverge radially outwardly with respect to the surrounding casing. Preferably, the central body protrudes from the casing in order to increase coejection of atmospheric air surrounding the nozzle.

A nozzle having a rectangular front and parallel exhaust passages preferably has a distance between passages that is at least three times the square root of the product of slot length multiplied by the slot width.

BRIEF DESCRIPTION OF THE DRAWINGS

The invention will now be described in the following in greater detail with reference to the accompanying drawings, wherein:

FIG. 1 is an end view of a circular nozzle according to a first embodiment of the invention;

FIGS. 2*a* and 2*b* are cross-sectional views taken along line II—II in FIG. 1 showing two different embodiments of the invention;

FIG. 3 is an end view of a second embodiment of a circular nozzle of the invention;

FIG. 4 is an end view of a rectangular nozzle according to the invention;

FIG. 5 is a cross-sectional view taken along line V—V in FIG. 4;

FIG. 6 is a cross-sectional view taken along line VI—VI in FIG. 7;

FIG. 7 is a side elevational view of another embodiment of the invention, shown in 5:1 scale; and FIG. 8 is a cross-sectional view taken along line VIII—VIII in FIG. 7.

DETAILED DESCRIPTION

Figure 2A:
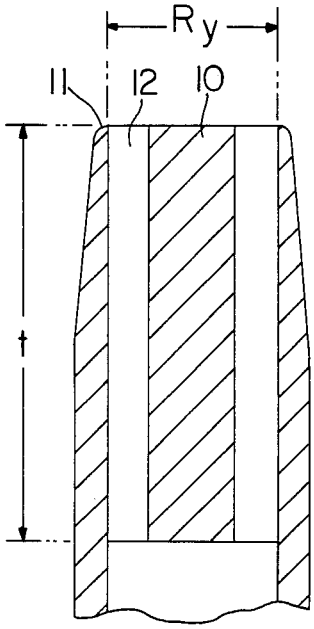

The nozzles of this invention comprise a central body 10 with longitudinal parallel slots and is surrounded by a thin wall casing 11. The slots form narrow exhaust passages 12 together with the casing 11, wherein the passages have a cross-sectional length L no more than ten times the cross-sectional width d of the slots and a depth, or axial length, t at least five to ten times the length of the slots.

When a gas is evacuated to the atmosphere from a closed system at high speed through a passage or conduit a turbulence is created, which generates a very loud noise. Since it is easier to dampen high frequences of sound, it is acoustically advantageous to replace a large passage by several small passages. The maximum generation of sound for a circular passage takes place at a frequency $f_{max}$ which is proportional to diameter d of the passage and therefore the diameter should be selected as small as possible.

For a rectangular passage according to the invention, the $f_{max}$ has proven to be proportional to the square root of the product of slot length L multiplied by the slot width d, up to very high factors of L/d. It will, however, not be practical to use larger values for L/d than 10. (Note that $f_{max}$ will only be proportional to d for values of $L/d \approx 100$ and higher, but this is of no concern in the field of blowing nozzles.) Preferably the maximum frequency should be close to or even above 15,000 Hz, i.e. above the normal upper limit for human hearing. For this reason the exhaust passages 12 are as narrow as possible, without risk for clogging by debris in the exhaust air. At the same time sufficient outlet area is achieved by the number of exhaust passages, which number can be varied depending on the needs.

A risk while using several adjacent exhaust passages, is that they may function acoustically like one large opening, lif they are relatively situated too close. For this reason the distance between the slot-formed exhaust passages are about three times the width d of one slot, and they do not extend further than about half the outer radius $R_y$ towards the center of the nozzle.

It has also been found that the generation of noise is reduced when an air jet can convey the surrounding gas. To enable this the nozzle exhaust passages should be placed near the outskirts of the nozzle front. This conveying of surrounding gas can be enhanced when the central body 10 protrudes axially out of the casing.

From FIGS. 2*a* and 2*b* it appears that the slot-formed exhaust passages 12 reach far into the nozzle. Experiments have proven that the generation of noise is gradually reduced by increasing slot depth t, until the slot depth reaches a value between five to ten times the slot length L. The smaller value relates to a diverging passage, i.e. as in the embodiment of FIG. 2*b*.

FIG. 3 shows a variant of the nozzle according to the invention, wherein the slots have two different lengths $L_1$ and $L_2$ respectively. This embodiment enables a larger blowing capacity for a given frontal area. This arrangement, however, results in a slightly higher sound level.

FIGS. 4 and 5 show a rectangular nozzle according to the invention having four exhaust passages 12 extending through a central body 10, which is surrounded by a four-sided casing 11. As in the above described circular nozzle, the exhaust passages are narrow and slot-formed. The distance between the passages are at least three times the square root of the product of slot length L multiplied by the slot width d. The exhaust passages 12 can be cut into the central body from both the long sides, so that the body is maintained in one piece, which can be pushed axially into the casing 11. Just as in the former embodiment, the slot length L is no more than ten times the slot width d and the slot depth t is at least five to ten times the slot length L. The passages can also be made converging in the direction of the gas stream towards the nozzle front.

FIGS. 6, 7 and 8 show a variant of the invention wherein the exhaust opening 12, as seen in their radial cross-section, diverge radially outwardly. This embodiment is especially preferable when producing very narrow blowing nozzles having a frontal diameter of about 5 mm. In this embodiment the exhaust passages can extend radially further in towards the center of the nozzle since they diverge as mentioned above, without conflicting with the condition that the smallest distance between adjacent passages must be three times the width of the slot-formed passages, which contributes to a further increased blowing force for any given nozzle frontal area. If the nozzle is pointed as shown in FIGS. 7 and 8 its accessibility is enhanced and it can be used to clean very small drill holes.

Tests made with the nozzles according to the invention to compare them with a conventional blowing nozzle having circular passages with the same total outlet area (80 $mm^2$) and the same working pressure (600 kPa) and the same blowing force (20 N at a distance of 10 cm) have established that the noise is reduced from 113 dB(A) for the conventional nozzle, to 96 dB(A) for the new nozzle. This very large reduction of noise will significantly reduce the cost when building new factories or can be utilized to improve conditions within existing factories.

One reason for the surprisingly good test results for the nozzle according to the invention is its ability to convey surrounding air.

Traditionally the inner form of a exhaust passage has been considered to have no importance for the generation of noise which takes place within the turbulence outside the nozzle. However, an air jet leaving a hole in a thin wall can cause a back flow along the fringes of the hole, which back flow increases the turbulence and the generation of noise.

The proportionally large depth of the slot-formed passages at the nozzles according to the invention prevents this back flow and therefore contributes to the lowered noise level.

The invention is not limited to the above described embodiments and several variants are possible within the scope of the accompanying claims. The central body can be molded, cut or extruded at a comparatively low cost.

I claim:

1. A blowing nozzle for a highly pressurized gaseous fluid comprising:

at least two narrow exhaust passages each in the form of a slot having a closed, substantially rectangular cross-section having a longitudinal axis, a cross-sectional width insignificantly larger than the size of particles occurring in said fluid, a cross-sectional length of no more than ten times the average width of each slot, and a depth in the direction of said longitudinal axis of at least five to ten times said length of said slot;

said longitudinal axes being substantially parallel.

2. A blowing nozzle as claimed in claim 1 wherein:

said nozzle has a central longitudinal axis and comprises a central body and a casing surrounding said central body in contacting engagement therewith; and said at least two passages comprise several exhaust passages in said central body extending parallel to said longitudinal axis of the nozzle.

3. A blowing nozzle as claimed in claim 1 wherein:

said nozzle has a central longitudinal axis and a circular cross-sectional shape; and said exhaust passages are arranged in circular spaced relationship about said central longitudinal axis with the cross-sectional lengths of said slots extending radially, the spacing between the centers of adjacent slots being a minimal distance of three times said cross-sectional width.

4. A blowing nozzle as claimed in claim 2 wherein:

said nozzle has a circular cross-sectional shape; and said exhaust passages are arranged in circular spaced relationship about said central longitudinal axis with the cross-sectional lengths of said slots extending radially, the spacing between the centers of adjacent slots being a minimal distance of three times said cross-sectional width.

5. A blowing nozzle as claimed in claim 3 wherein:

said passages diverge radially outwardly along said longitudinal axis of said passages in the direction of the nozzle outlet.

6. A blowing nozzle as claimed in claim 4 wherein:

said passages diverge radially outwardly along said longitudinal axis of said passages in the direction of the nozzle outlet.

7. A blowing nozzle as claimed in claim 5 wherein:

each slot has radially inner and outer sidewalls; and said inner sidewall diverges radially outwardly from a position adjacent said central longitudinal axis of said nozzle toward the nozzle outlet.

8. A blowing nozzle as claimed in claim 4 wherein:

said central body protrudes from said casing at the nozzle outlet so that conveyance of atmospheric air surrounding the nozzle is increased.

9. A blowing nozzle as claimed in claim 6 wherein:

said central body protrudes from said casing at the nozzle outlet so that conveyance of atmospheric air surrounding the nozzle is increased.

10. A blowing nozzle as claimed in claim 8 wherein:

said protruding central body comprises a protruding part having a conical surface providing a substantially pointed outlet end for the nozzle.

11. A blowing nozzle as claimed in claim 1 wherein:

said nozzle has a rectangular cross-sectional shape;

said slots are parallel; and the distance between adjacent slots is at least three times the square root of the product of said slot length multiplied by said slot width.

12. A blowing nozzle as claimed in claim 3 wherein:

said slots diverge radially outwardly in radial cross-section.

13. A blowing nozzle as claimed in claim 4 wherein:

said slots diverge radially outwardly in radial cross-section.

14. A blowing nozzle as claimed in claim 8 wherein:

said slots diverge radially outwardly in radial cross-section.

15. A blowing nozzle as claimed in claim 10 wherein:

said slots diverge radially outwardly in radial cross-section.

* * * * *